US008580101B2

(12) United States Patent
Darcy

(10) Patent No.: US 8,580,101 B2
(45) Date of Patent: Nov. 12, 2013

(54) OUTDOOR-SUITABLE ANTIQUE COPPER COLOR ALUMINUM MATERIAL AND PROCESS

(75) Inventor: Kevin Herman Darcy, North Muskegon, MI (US)

(73) Assignee: Lorin Industries, Muskegon, MI (US)

( * ) Notice: Subject to any disclaimer, the term of this patent is extended or adjusted under 35 U.S.C. 154(b) by 253 days.

(21) Appl. No.: 12/571,885

(22) Filed: Oct. 1, 2009

(65) Prior Publication Data

US 2010/0092797 A1 Apr. 15, 2010

Related U.S. Application Data

(60) Provisional application No. 61/101,875, filed on Oct. 1, 2008.

(51) Int. Cl.

| | |
|---|---|
| ***C25D 7/06*** | (2006.01) |
| ***C25D 11/24*** | (2006.01) |
| ***C25D 5/44*** | (2006.01) |
| ***C25D 11/16*** | (2006.01) |

(52) U.S. Cl.
USPC ..... 205/139; 205/202; 205/213

(58) Field of Classification Search
USPC ..... 205/139, 202, 213
See application file for complete search history.

(56) References Cited

U.S. PATENT DOCUMENTS

| | | | | |
|---|---|---|---|---|
| 3,382,160 A | | 5/1968 | Asada | |
| 3,616,309 A | * | 10/1971 | Asada et al. | 205/107 |
| 3,909,367 A | * | 9/1975 | Patrie et al. | 205/50 |
| 3,989,605 A | * | 11/1976 | Yanagida et al. | 205/139 |
| 4,014,758 A | | 3/1977 | Kawai et al. | |
| 4,070,255 A | * | 1/1978 | Hasegawa et al. | 205/105 |
| 4,180,443 A | | 12/1979 | Darrow | |
| 4,251,330 A | | 2/1981 | Sheasby et al. | |
| 4,737,246 A | | 4/1988 | Powers et al. | |
| 5,290,424 A | | 3/1994 | Mozelewski et al. | |
| 5,478,414 A | | 12/1995 | Mozelewski et al. | |
| 5,637,404 A | | 6/1997 | Bombalski et al. | |
| 5,955,147 A | | 9/1999 | Serafin | |
| 7,384,570 B2 | | 6/2008 | Marczak et al. | |
| 2002/0096434 A1 | | 7/2002 | Marczak et al. | |

OTHER PUBLICATIONS

Coilworld; Copper Anodized Aluminum: A new "Kid on the Block" for Alliance Metals; Sep./Oct. 2009.
Letter to Mr. Ed Weinfurtner; from Gregory S. Cooper; dated Oct. 8, 2009.
Continuous Coil Anodizing.
International Search Report; Dec. 4, 2009.
Copper Elegance . . . Without the Patina; http://www.linetec.com/ANODIZE/CopperAnodize.htlm.

* cited by examiner

*Primary Examiner* — Edna Wong
(74) *Attorney, Agent, or Firm* — Barnes & Thornburg LLP

(57) ABSTRACT

A copper-substitute aluminum material made from a copper and cobalt anodizing process. The process includes the steps of: anodizing the aluminum material by submersing it in a basic sulfuric acid to build an anodic layer producing anodized aluminum material; combining copper and cobalt salts together in one bath; lowering the pH of the bath to between about 1.0 and about 3.0; coloring the anodized aluminum material electrolytically by submersing the anodized aluminum material in the bath of copper and cobalt salts; and applying an electrical current to the bath plating the copper and cobalt salts into the anodized aluminum material.

8 Claims, 1 Drawing Sheet

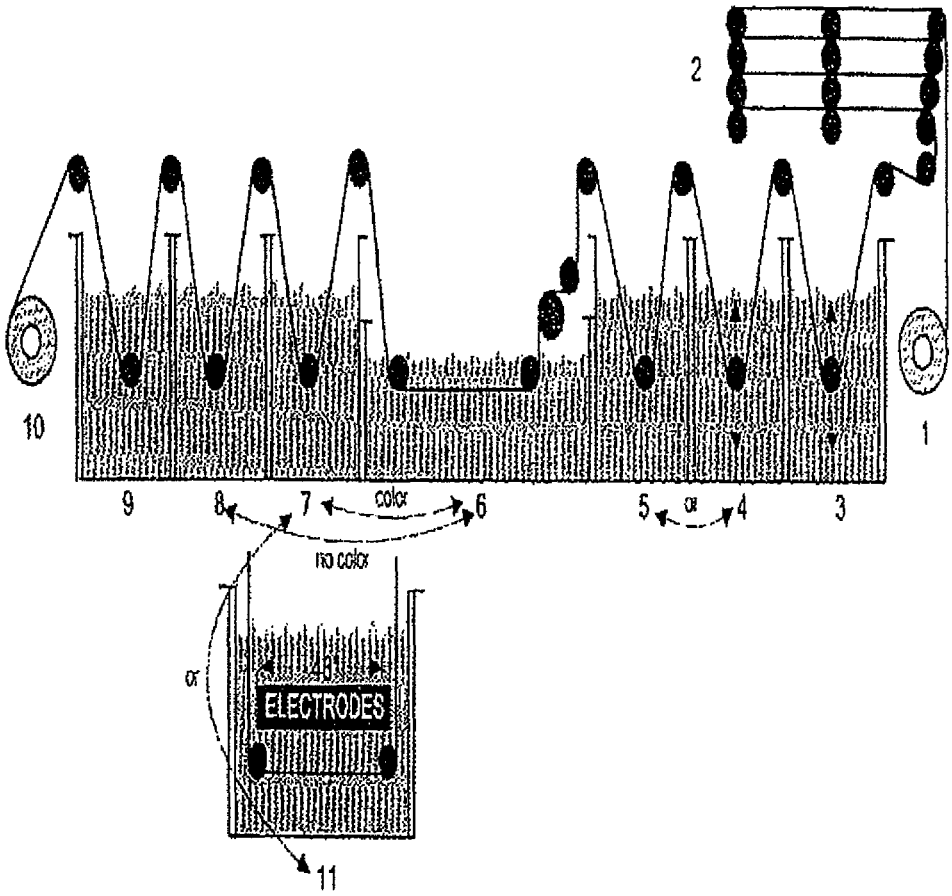
2
10
1
9
8
7
color
6
5
α
4
3
no color
α
ELECTRODES
11

OUTDOOR-SUITABLE ANTIQUE COPPER COLOR ALUMINUM MATERIAL AND PROCESS

RELATED APPLICATIONS

This present application is related to and claims benefit to U.S. Provisional Patent Application Ser. No. 61/101875, filed on Oct. 1, 2008, entitled Aluminum Coloring Process.

TECHNICAL FIELD AND SUMMARY

The present disclosure relates generally to electrolytically coloring aluminum to simulate antique copper in a way that is also ultra-violet (UV) light stable, making it useable for outdoor applications.

Copper is a well known metal used for everything from electrical wiring, to decorative metal works, to rain gutters and down spouts. It is equally well known that copper is a relatively expensive material, especially when compared to aluminum. Copper also patinas over time meaning it oxidizes when exposed to the outdoor elements. The color of the exposed copper darkens and then turns green.

Aluminum is a silver-white, light weight metal that is often formed into sheets and used for a myriad of purposes including gutters, appliance panels, architectural panels, ceiling panels, mailboxes, roofing, signage, windows, doors, elevators, and the like. Aluminum can be colored by a variety of means, including electrolytic plating. Different metallic salts create a variety of colors such as cobalt and tin providing brown or bronze tints on the surface of the aluminum.

Anodizing creates a layer of aluminum oxide on the top surface of the aluminum. This protects the aluminum underneath because the oxide layer has a higher corrosion and abrasion resistance than bare aluminum. An illustrative process includes oxidizing the surface and the coloring the oxidized surface. Creating the aluminum oxide surface involves applying an electrical charge to a tank containing a bath of sulfuric acid and water. When the aluminum is submerged in the tank, aluminum oxide forms on the surface. The aluminum is then submerged into a second tank coloring the oxidized surface. This second tank includes a bath of metal salts of either cobalt, tin, zinc or copper. An electrical current is applied to the bath causing the metal salt to deposit into anodic pores on the aluminum oxide layer. The type of metal oxide in the bath and the length of time the aluminum is held in the bath can determine the color and shade of that color.

Aluminum can be anodized through either a continuous roll or a batch process. These are not the same processes, however. For example, continuous roll anodizing involves the continuous unwinding of coils through a series of anodizing tanks and then rewinding the coil upon completion of the circuit. The sheet is not attached to a rack that conducts current. In contrast, batch or piece anodizing involves anodizing individual extrusions, castings and formed parts. Each part is individually attached to racking and then immersed into treatment tanks. Bus bars are attached to the racking to attract the charge from the bath.

Aluminum can be conventionally anodized to create a copper color using organic colorant. This application is not UV stable, however. Copper metal salt has also been utilized with the electrolytic process to obtain a copper color. Problems with this include, first, the color being very bright. Shiny new copper is a familiar color, but for certain applications, such as outdoor rain gutters and down spouts, it may not look appropriate. Typically, copper that is used outside quickly loses its shiny new luster. Again, real copper patinas when exposed to the outdoor elements. The color of the exposed copper darkens and then turns green. "Antique copper" is the dark copper color. As such, "new" looking copper color may appear odd in outdoor applications.

Second, like using the organic colorant, copper anodized aluminum cannot hold its color. The anodize is not UV stable. It tends to fade over time, losing the copper appearance it once had. This may be why copper anodized aluminum is not used for applications such as gutters and downspouts.

This present disclosure describes a copper substitute that is more the color of an antique copper and can be used outdoors, unlike conventional copper-color anodized aluminum. The aluminum described in this disclosure can be used for applications such as (although not limited to) rain gutters and downspouts. In one embodiment, the process can be used with continuous roll anodizing as distinguished from batch anodizing. In another embodiment, the process can be used with batch anodizing.

An embodiment of this disclosure includes combining both copper and cobalt salts in a coloring bath at a low pH. A problem with the copper salt, however, is it may fall out of solution at a higher pH. Cobalt is conventionally used at a higher pH, about 4.5 Because of the problem with copper falling out of solution over a period of time, just combining the two salts is not workable. Instead, the pH is adjusted lower to about the 2+/−1 range, for example, which has the effect of keeping the copper salt in solution. Despite this lower pH, the copper and cobalt salts unexpectedly produced color and a consistent plating. In addition, the amperage of the current applied to the bath was lowered to only about 70 to 80 amps, rather than a conventional 200-300 amps.

The net effect produced a color anodized aluminum that looks like "antique copper." This antique copper aluminum is also more UV stable which is also needed for outdoor use and not characteristic of conventionally anodized copper colored aluminum.

An illustrative embodiment of a process of producing a copper-substitute aluminum material comprises the steps of: cleaning aluminum material with an alkali or acid; anodizing the aluminum material by submersing it in a basic sulfuric acid to build an anodic layer producing anodized aluminum material; combining copper and cobalt salts together in one bath; lowering the pH of the bath to between about 1.0 and about 3.0; coloring the anodized aluminum material electrolyticly by submersing the anodized aluminum material in the bath of copper and cobalt salts; and applying an electrical current to the bath plating the copper and cobalt salts into the anodized aluminum material.

In the above and other illustrative embodiments, the process of producing the copper-substitute aluminum material may further comprise the steps of: sealing the anodized aluminum material after coloring by submersing the anodized aluminum material in a bath of nickel acetate followed by hot water; pretreating the aluminum material after cleaning it in alkali or acid and before anodizing by etching or chemically brightening it; lowering the pH of the bath from about 1 to about 3; and lowering the pH of the bath from about 2 to about 2.5.

The above and other illustrative embodiments may further include: the bath comprising about 3-7 grams per liter copper salt and about 40-80 grams per liter cobalt salt; the bath comprising copper salt, cobalt salt, magnesium salt, boric acid, tartaric acid, sulfuric acid, and magnesium oxide; the bath comprising about 3-7 grams per liter copper salt, about 40-80 grams per liter cobalt salt, about 40-80 grams per liter magnesium salt, about 10-30 grams per liter boric acid, about 0-10 grams per liter tartaric acid, sulfuric acid, and magnesium oxide; the copper-substitute aluminum material being a continuous roll of aluminum sheet with a charge applied to the bath of about 70 to 80 amps; and the copper-substitute aluminum material being a plurality of aluminum pieces wherein the antique copper color is generated as a function of time the aluminum pieces are submersed in the bath.

Another illustrative embodiment of a process of producing a copper-substitute aluminum material comprising the steps of submersing the aluminum material in a bath comprising a copper salt and a cobalt salt that colors and UV stabilizes the aluminum material.

The above and other processes of producing a copper-substitute aluminum material may further include the bath comprising about 3-7 grams per liter copper salt and about 40-80 grams per liter cobalt salt; the bath comprising copper salt, cobalt salt, magnesium salt, boric acid, tartaric acid, sulfuric acid, and magnesium oxide; the bath comprising about 3-7 grams per liter copper salt, about 40-80 grams per liter cobalt salt, about 40-80 grams per liter magnesium salt, about 10-30 grams per liter boric acid, about 0-10 grams per liter tartaric acid, sulfuric acid, and magnesium oxide; and comprising the step of producing two or more anodized layers.

Another illustrative embodiment of the present disclosure provides a copper-substitute comprising an anodized aluminum material. The surface coloring is from a combination of copper and cobalt salts that is UV stable.

The illustrative processes described herein are repeatable and produce a uniform color and can obtain various depths of color shades. They also allow for a variety of color depths along with the variety of various anodize oxide films for continued protection of the aluminum surface.

Additional features and advantages of this anodizing process will become apparent to those skilled in the art upon consideration of the following detailed description of the illustrated embodiment exemplifying the best mode of carrying out the anodizing process as presently perceived.

BRIEF DESCRIPTION OF DRAWINGS

The present disclosure will be described hereafter with reference to the attached drawings which are given as non-limiting examples only, in which:

FIG. 1 is a side schematic view illustrating a process for anodizing aluminum.

DETAILED DISCLOSURE OF ILLUSTRATIVE EMBODIMENTS

The present disclosure is directed to anodizing aluminum and then electrolytically coloring the aluminum in a bath including both copper salt and cobalt salt. The electrolytic coloring process produces various copper and bronze shades that are light resistant. Copper salt provides a copper or red hue and the cobalt salt in contrast provides a bronze tint. The process may, for example, be used to produce bronze tints with red hues for an "antique copper" color appearance. The bath solution can be modified to produce a variety of shades.

The process in accordance with an embodiment of the present disclosure can be readily repeated and produces a uniform color. The process can also readily be modified to obtain different color shades and enable different depths of anodize oxide films.

A schematic view of FIG. 1 shows a process for anodizing a continuous roll of aluminum. The process shown is a known process for anodizing aluminum except for the particular coloring bath added. As shown in this view, a web of aluminum sheet is unrolled at 1. The aluminum is then fed through a raw coil accumulator so the machine may continue running while the start of the roll is attached to metal already threaded in the machine. In an illustrative embodiment, the aluminum sheet can then be submerged in an alkaline or acid cleaner bath 3. It is appreciated that in illustrative embodiments there is a rinse between each tank. After cleaning, either a light, medium, or heavy caustic etching 4 and/or bright dip 5 can be applied to the aluminum. A tank 6 of sulfuric acid is used to anodize the aluminum. The continuous roll submerges in the sulfuric acid oxidizing the surfaces of the aluminum.

To color the aluminum, it can be submerged in either a colored tank 7 of organic dye or an inorganic metal salt. As shown in the drawing, tank 11 can substitute for tank 7. A preseal nickel acetate tank 8 can also be applied to the aluminum. Lastly, the aluminum can be submerged in a tank of boiling distilled water to apply a final seal. The aluminum is then rewound where it can be used for various applications.

The process for electrolytically coloring metal in accordance with the present disclosure, including submersing the metal in a bath that includes both copper salts and cobalt salts to electrolytically color the metal, may be carried out in any suitable manner, such as in tank 11 of FIG. 1.

An illustrative embodiment of the preparation and anodization process may include the following steps:

Step 1: Metal in the form of raw aluminum is cleaned of its mill oils. This can be done in any suitable manner such as, for example, submersing the metal in an alkali bath or acid bath for about 30-90 seconds.

Step 2: The metal is pretreated. This can be done in any suitable manner such as, for example, by cleaning, chemically brightening, or etching or dulling the metal. The actual process may depend upon the desired look to be achieved.

Step 3: The metal is anodized in any suitable manner, such as a basic sulfuric acid process to build the anodic layer. The time in the tank is usually between 1-4 minutes. The number of anodized layers may vary depending on the end use of the product or the desired results.

Step 4: The metal is colored by the electrolytic coloring process. Copper and cobalt salts are diluted in the bath, such as tank 11 of *Fig.* 1, and an electrical current is applied to the solution, thus plating the metal salts into the anodic pore. The parameters may be as follows: the metal is submerged 1-6 minutes in the tank at 80-100 degrees F. temp with a pH of 1.0-3.0. The lower pH level assists DC current flow, thus coloring the sheet in a more uniform manner while also keeping the copper sulfate in solution.

Step 5: The metal is sealed in any suitable manner such as, for example, by a duplex seal formed by submersing the metal in a tank of nickel acetate for 30-90 seconds followed by a hot water seal to hydrate the pore for 5-20 minutes depending on the anodize film thickness.

The cobalt salt and copper salt used in the electrolytic coloring process may be any suitable concentration and the bath solution may include any other suitable ingredients, including, for example, magnesium salt, boric acid, tartaric acid, sulfuric acid, and magnesium oxide. In accordance with one embodiment of the present disclosure, for example, the bath solution may comprise:

Copper salt: 3-7 grams per liter
Cobalt salt: 40-80 grams per liter
Magnesium salt: 40-80 grams per liter
Boric acid: 10-30 grams per liter
Tartaric acid: 0-10 grams per liter
Sulfuric acid to lower pH
Magnesium oxide to raise pH During continuous roll anodizing, the bath of cobalt and copper is charged. The anodized metal attracts the current causing the plating of the color on the metal to occur. Because of this, plating the antique copper is more difficult for continuous roll anodizing. Using conventional setting fails to achieve consistent plating. Too much current causes the edges to burn, whereas too little causes the color to be too light.

To that end, in addition to lowering the pH, lowering the strength of the current below typical levels was found to produce a more consistent antique copper plating. Typically, plating cobalt occurs when applying about 200-300 DC Amps. This new copper color, however, was found to plate better at only about 70 to 80 amps. These amperages can be adjusted to affect the precise desired color.

In contrast, with batch anodizing the bath is charged, but a busbar or busbars are attached to the rack to draw the current in the bath. Illustratively, the copper color process can be regulated by changing the time the metal is submerged in the bath.

In addition to the benefits described above, the present disclosure provides many other benefits. For example, because the cost of true copper alloys has risen dramatically, the present disclosure enables anodized aluminum to be used as a substitute for copper alloys. Further, the metal will not patina over time like true copper alloys. It will also resist UV light and, thus, is suitable for exterior use. The present disclosure also allows for a variety of color depths along with the variety of various anodize oxide films for continued protection of the aluminum surface. The present disclosure can be used in connection with extrusion or batch processes, continuous coil processes, or any other aluminum coloring process.

While embodiments have been illustrated and described in the drawings and foregoing description, such illustrations and descriptions are considered to be exemplary and not restrictive in character, it being understood that only illustrative embodiments have been shown and described and that all changes and modifications that come within the spirit of the disclosure are desired to be protected. The description and figures are intended as illustrations of embodiments of the disclosure, and are not intended to be construed as having or implying limitation of the disclosure to those embodiments. There is a plurality of advantages of the present disclosure arising from various features set forth in the description. It will be noted that alternative embodiments of the disclosure may not include all of the features described yet still benefit from at least some of the advantages of such features. Those of ordinary skill in the art may readily devise their own implementations of the disclosure and associated methods, without undue experimentation, that incorporate one or more of the features of the disclosure and fall within the spirit and scope of the present disclosure and the appended claims.

What is claimed is:

1. A process of producing a copper-substitute aluminum material comprising the steps of:

providing a continuous roll of aluminum material;

cleaning the aluminum material with an alkali or acid bath;

anodizing the aluminum material by submersing the aluminum material in a basic sulfuric acid to build an anodic layer producing anodized aluminum material;

combining copper and cobalt salts together in one bath;

lowering the pH of the bath to between about 1.0 and about 3;

coloring the anodized aluminum material electrolytically by submersing the anodized aluminum material in the bath of copper and cobalt salts;

applying an electrical current of about 70 to about 80 amps to the bath plating the copper and cobalt salts into the anodized aluminum material; and resulting in a consistent copper plating on the anodized aluminum material.

2. The process of producing the copper-substitute aluminum material of claim 1, further comprising the steps of:

sealing the anodized aluminum material after coloring by submersing the anodized aluminum material in a bath of nickel acetate followed by hot water.

3. The process of producing the copper-substitute aluminum material of claim 1, further comprising the steps of:

pretreating the aluminum material after cleaning the aluminum material with the alkali or acid bath and before anodizing by etching or chemically brightening the aluminum material.

4. The process of producing the copper-substitute aluminum material of claim 1, wherein the bath comprises about 3-7 grams per liter copper salt and about 40-80 grams per liter cobalt salt.

5. The process of producing the copper-substitute aluminum material of claim 1, wherein the bath comprises copper salt, cobalt salt, magnesium salt, boric acid, tartaric acid, sulfuric acid, and magnesium oxide.

6. The process of producing the copper-substitute aluminum material of claim 1, wherein the bath comprises about 3-7 grams per liter copper salt, about 40-80 grams per liter cobalt salt, about 40-80 grams per liter magnesium salt, about 10-30 grams per liter boric acid, and about 0-10 grams per liter tartaric acid; and wherein either sulfuric acid is added to lower pH, or magnesium oxide is added to raise pH.

7. The process of producing the copper-substitute aluminum material of claim 1, further comprising the step of lowering the pH of the bath to about 1 to about 3.

8. The process of producing the copper-substitute aluminum material of claim 1, further comprising the step of lowering the pH of the bath to about 2 to about 2.5.

* * * * *